US006014157A

United States Patent [19]

Slot et al.

[11] Patent Number: 6,014,157

[45] Date of Patent: Jan. 11, 2000

[54] IMAGE FORMING ELEMENT HAVING ACCURATE CONNECTION WITH THE ELECTRONIC COMPONENTS OF THE CONTROL UNIT

[75] Inventors: Marcel Slot; Lamberdina J. A. M. Driessen-Olde Scheper; Norbertus G. C. M. Van Reuth, all of Venlo, Netherlands

[73] Assignee: Oce-Technologies B.V., Venlo, Netherlands

[21] Appl. No.: 08/840,632

[22] Filed: Apr. 25, 1997

[30] Foreign Application Priority Data

Apr. 25, 1996 [EP] European Pat. Off. ..... 96201107

[51] Int. Cl.[7] ..... B41J 2/39; B41J 2/395

[52] U.S. Cl. ..... 347/141

[58] Field of Search ..... 347/141, 55, 120, 347/151, 153, 158, 115, 112, 121; 399/119, 171; 358/296, 300; 346/138; 101/DIG. 37

[56] References Cited

FOREIGN PATENT DOCUMENTS

247699A1 5/1987 European Pat. Off. .
595388A1 10/1993 European Pat. Off. .
635768A1 6/1994 European Pat. Off. .

*Primary Examiner*—N. Le
*Assistant Examiner*—L. Anderson
*Attorney, Agent, or Firm*—Birch, Stewart, Kolasch & Birch, LLP

[57] ABSTRACT

An image-forming element having a hollow cylindrical drum body, a plurality of circumferentially extending electrodes formed on the outer circumferential surface of the drum body, a control unit disposed inside of the drum body, and a contact member for electrically connecting each of the electrodes individually to the control unit. The contact members are arranged in a plurality of rows extending in the axial direction of the body and each of the contact members, when considered from the inner side of the wall of body, has a dimension, considered in the axial direction of the body, which is at least twice the corresponding dimension of an electrode.

6 Claims, 6 Drawing Sheets

IMAGE FORMING ELEMENT HAVING ACCURATE CONNECTION WITH THE ELECTRONIC COMPONENTS OF THE CONTROL UNIT

BACKGROUND OF THE INVENTION

1. Field of the Invention

The invention relates to an image-forming element comprising a hollow cylindrical drum body which on an outer circumferential surface is provided with a plurality of circumferentially extending electrodes which are electrically insulated from one another, an electronic control unit disposed inside of the drum body for energizing said electrodes, and contact means for electrically connecting each of the electrodes individually to the control unit through the circumferential wall of the drum body. The invention also relates to a method for manufacturing such an image-forming element.

2. Description of Background Art

An image-forming element of this type is usable in a so-called direct induction printer the functional principle of which is described for example in EP-A1-0 247 699. In such a printer, the electrodes on the surface of the drum body are covered by a dielectric layer, and a rotatable sleeve is disposed along the drum body so that the surfaces of the drum body and the sleeve form a gap which extends at right angles to the electrodes of the drum. A stationary magnetic knife is disposed inside of the sleeve for generating a magnetic field in the gap. A uniform layer of electrically conductive and magnetically attractable toner powder is applied to the surface of the sleeve. In an image-forming zone defined by the magnetic field in the gap, the toner powder is transferred onto the surface of the drum, depending on the voltage applied to the electrodes thereof. Thus, by rotating the drum body and energizing the electrodes in accordance with image information supplied to the control unit, a toner image is formed on the surface of the drum. Alternatively, a uniform layer of toner powder may be applied to the surface of the drum, and the toner powder may selectively be removed from the drum in accordance with the energizing pattern of the electrodes.

A conventional image-forming element and a method of manufacturing the same are disclosed in EP-A1-0 595 388. The electronic components of the control unit and a pattern of electrical conductors are provided on a plate-like substrate. The conductors to be connected to the electrodes of the drum terminate at a rectilinear edge of the substrate, so that a terminal array is formed in which the individual terminals, i.e. the ends of the conductors, have the same pitch and the same width as the electrodes on the drum. The substrate carrying the conductor pattern and the electronic components is mounted inside of the drum body such that the edge forming the terminal array is inserted through a longitudinal slot in the drum body. The remaining free spaces in the slot are filled with epoxy resin so that the terminals are insulated from the drum body. The edge portion of the substrate which projects out of the slot is etched away so that only the ends of conductors are left, which will then slightly project beyond the surface of the cylindrical drum. The surface of the cylinder is then covered with an insulating layer having a thickness equal to the length of the projecting ends of the conductors. Then, the electrodes are formed on the insulating layer on the surface of the drum such that each electrode will be in contact with the end of one of the conductors.

It will be understood that the pitch of the electrodes determines the resolution of the printer. For example, in case of a printer with a resolution of 23, 6 pixel per mm (600 dpi), the pitch of the electrodes will be no larger than approximately 40 $\mu$m. Since a sufficient insulating gap must be provided between adjacent electrodes, the width of each individual electrode will be as small as approximately 20 $\mu$m.

With the conventional manufacturing method, it is difficult and cumbersome to adjust the position of the substrate in the slot of the drum body such that each terminal will be correctly aligned with the associated electrode. In addition, since the projecting ends of the conductors forming the terminals for connection with the electrodes must also have very small dimensions, it is difficult to reproducibly manufacture an image-forming element in which all electrodes, which may be several thousands in number, are reliably and durably connected to the control unit.

SUMMARY AND OBJECTIONS OF THE INVENTION

It is accordingly an object of the invention to provide an image-forming element which can easily and reproducibly be manufactured and has an improved reliability and durability of the electrical connections between the individual electrodes and the control unit, and to provide a method for manufacturing such an image-forming element.

According to the invention an image-forming element is provided having a hollow cylindrical drum body including an outer circumferential surface having a plurality of circumferentially extending electrodes insulated from one another and from the drum body, an electronic control unit disposed inside the hollow cylindrical drum body and contact means for connecting the electrodes individually to the control unit, wherein the contact means are arranged in a plurality of rows extending substantially in an axial direction of the body and each of the contact means considered from the inner side of the wall of said body has a dimension, seen in the axial direction of the body, which is at least twice the corresponding dimension of an electrode.

Since the contact means passing through the circumferential wall of the cylindrical body, when considered from the inner side of the body and in the axial direction thereof, have a dimension which is considerably larger than the corresponding dimension of an electrode, an accurate connection with the electronic components of the control unit, disposed inside the cylindrical body, can be achieved on the other hand an accurate connection between each of the contact means and one of the circumferentially extending printing electrodes can also be achieved without having the requirement of extremely accurate positioning of the contact means passing through the wall of the cylindrical body. Thus a reliable and durable image-forming element can be manufactured without the requirement of an extreme accuracy in the positioning of the contact means.

In a preferred embodiment, the through-holes for contacting adjacent electrodes are staggered in the circumferential direction of the drum, and each through-hole has a smaller diameter at the outer circumferential surface of the drum and a larger diameter at the inner surface of the drum body. This greatly facilitates the electrical connection between the conductive material filled in the through-holes and the terminals of the control unit, because the positional tolerance of the control unit is determined by the comparatively large diameter of the through-holes at the inner surface of the drum body. This arrangement may advantageously be employed also in cases where the drum body is not made of metal but of an electrically insulating material.

A method for manufacturing the image-forming element is also set forth in the present invention.

The through-holes may be formed in the wall of a drum body by means of a laser beam or an electron beam. In order to provide an larger diameter for the through-hole at the internal surface of the drum, it is preferable to apply the beam, e.g. the laser beam, from inside the drum. Then, the convergence of the laser beam may be utilized to form the large diameter portion and the small diameter portion of the through-hole in a single operation. In an alternative embodiment, the large diameter portion is formed as a blind bore in a first step, and the small diameter portion of the through-hole is then formed from inside or outside of the drum in a second step.

In another embodiment, the through-hole having a large diameter is formed in a first step either from inside or outside of the drum. The drum body which in this embodiment is constructed of metal, such as aluminum, and is then anodized in order to form an insulating surface layer at the internal walls of the large diameter bores. The bores are filled with conductive material. Then, a uniform layer of metal (e.g. aluminum) or an insulating material (e.g. plastic such as epoxy resin) is applied over the outer surface of the drum body, and the through-contacts are completed in a second cycle of forming small diameter through-holes (anodizing in case the applied layer consists of metal), and filling the holes with conductive material. When a metal layer is applied, the anodizing process must be so controlled that the whole thickness of the metal layer is made electrically insulating.

It is also possible to form the plural rows of the contact means (e.g. the through holes) in a separate support and thereafter to secure the support in an elongated opening in the cylindrical wall. Alternately, each row of contacts means can be formed on a separate support element and a number of such support elements is then secured in a corresponding elongated opening of the cylindrical body.

If the inner diameter of the drum body is too small for accommodating the beam source therein, the drum body may be cut into at least two segments, beforehand, and the segments are then welded together for example by means of electron beam welding, after the through-holes or at least the large diameter portions thereof have been formed.

In a further embodiment, the electrodes on the outer surface of the drum body are formed by cutting grooves into the outer surface of the drum or the plated layer before the anodizing step, and by filling these grooves with conductive material forming the electrodes after the anodizing step. In this case, the wall surfaces of both the through-holes and the grooves can be made electrically insulating in the same anodizing step.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, a preferred embodiment of the present invention will be described with reference to the drawings.

Figure 1:
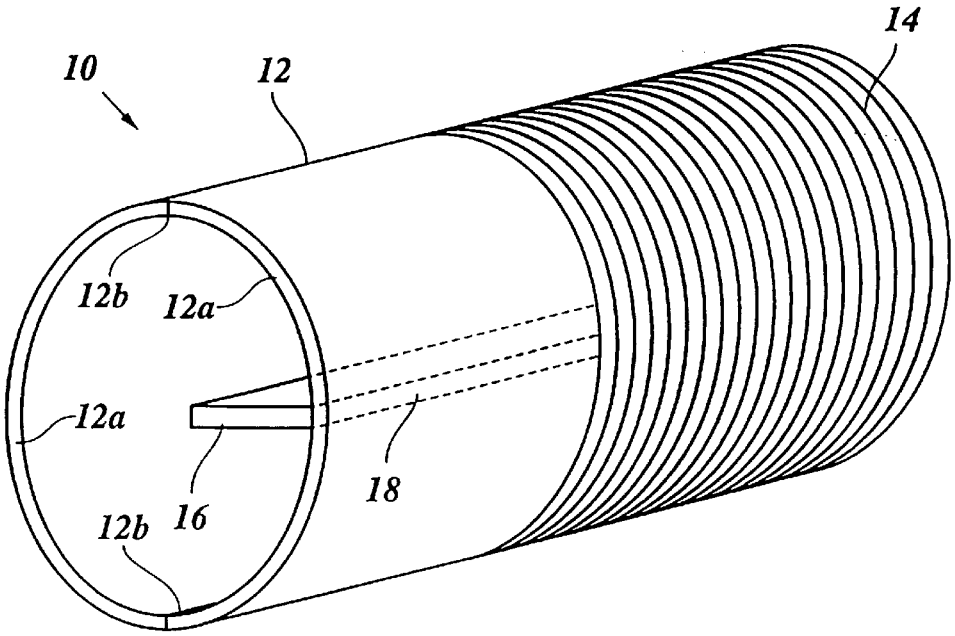
FIG. 1 is a schematic perspective view of an image-forming element.

The image-forming element 10 shown in FIG. 1 comprises a hollow cylindrical drum body 12 made of metal, preferably aluminum or an aluminum alloy. A plurality of circumferentially extending electrodes 14 are formed on the outer surface of the drum body 12. These electrodes 14 are electrically insulated from one another and from the drum body 12 and are covered by a thin layer of dielectric material (not shown in FIG. 1). While only a few electrodes 14 have been shown in FIG. 1 for reasons of clarity, the electrodes 14 are in practice provided substantially over the whole length of the drum body 12 and are arranged with a pitch of about 40 $\mu$m for example, corresponding to the desired resolution of the images to be formed.

A control unit 16 is shaped as an elongate body and is mounted inside of the hollow drum body 12 such that a terminal array 18 formed at a longitudinal edge of the elongate body adjoins the internal wall surface of the drum body. As is generally known in the art, the control unit 16 is arranged for individually applying a suitable high voltage to each of the electrodes 14 in accordance with the image information. For example, the control unit 16 may comprise a printed circuit board on which the electronic components are mounted and which carries a pattern of electrical conductors (not shown) which lead to the terminal array 18. Each of the conductors is electrically connected to a corresponding one of the electrodes 14 by contact means which will be described in detail hereinafter.

Figure 2:
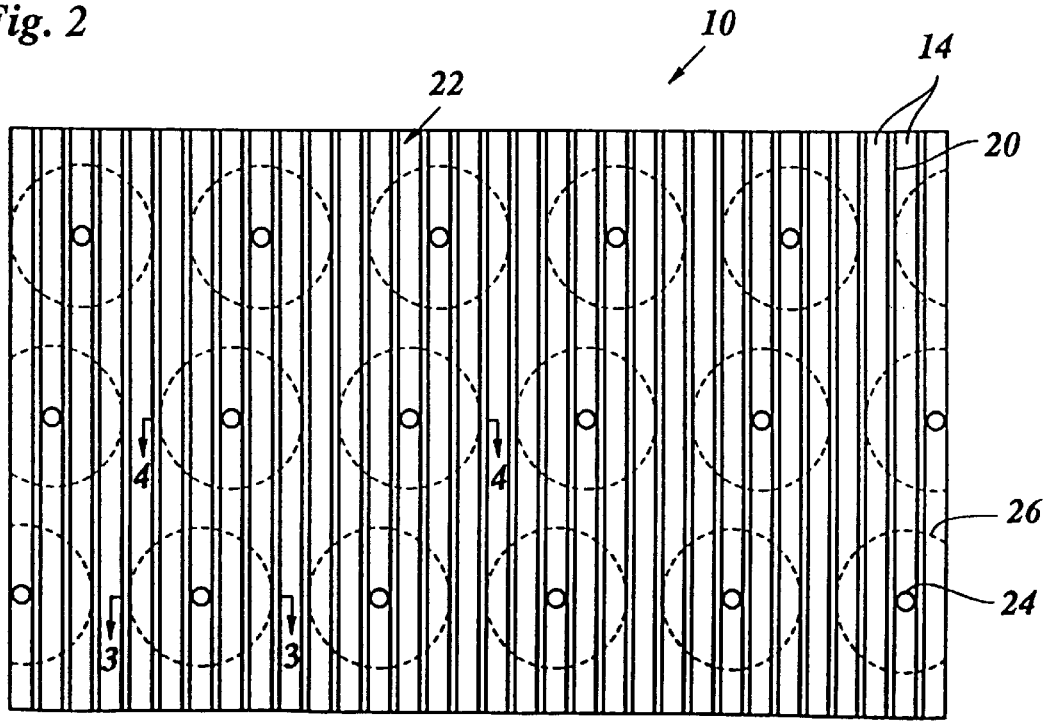
FIG. 2 is an enlarged view of a portion of the outer circumferential surface of the image-forming element.

As is shown in FIG. 2, the individual electrodes 14 are separated by insulating ridges 20 which, in the present example, have a width of slightly less than 20 $\mu$m, so that there remains a width of a bit more than 20 $\mu$m for each electrode 14. Each electrode is electrically connected to the associated conductor of the control unit 16 via a through-hole 22 which penetrates the wall of the drum body 12 and is filled with an electrically conductive material such as electrically conductive epoxy resin, solder paste, electrically conductive polymers or the like. Each through-hole 22 is composed of a small diameter portion or hole 24 and a large diameter portion or hole 26. The small diameter hole 24 is open to the outer circumferential surface of the drum body, has a diameter of approximately 20 $\mu$m and is so arranged that it makes contact with only one of the electrodes 14. The inner end of the small diameter hole 24 is open to the large diameter hole 26 which itself is open to the internal surface of the wall of the drum body 12 and has a diameter which is substantially larger than the pitch of the electrodes 14. In order to provide a sufficient clearance between the several large diameter holes 26, the through-holes 22 are staggered in the circumferential direction of the drum in six rows of which only three have been shown in FIG. 2.

When the control unit 16 is mounted inside the drum body 12, it has to be so adjusted that each of its conductors or terminals makes contact with the conductive material in only one of the large diameter holes 26. Because of the comparatively large diameter of these holes, the positional tolerance for the control unit is significantly larger than the pitch of the electrodes 14.

Figure 3:
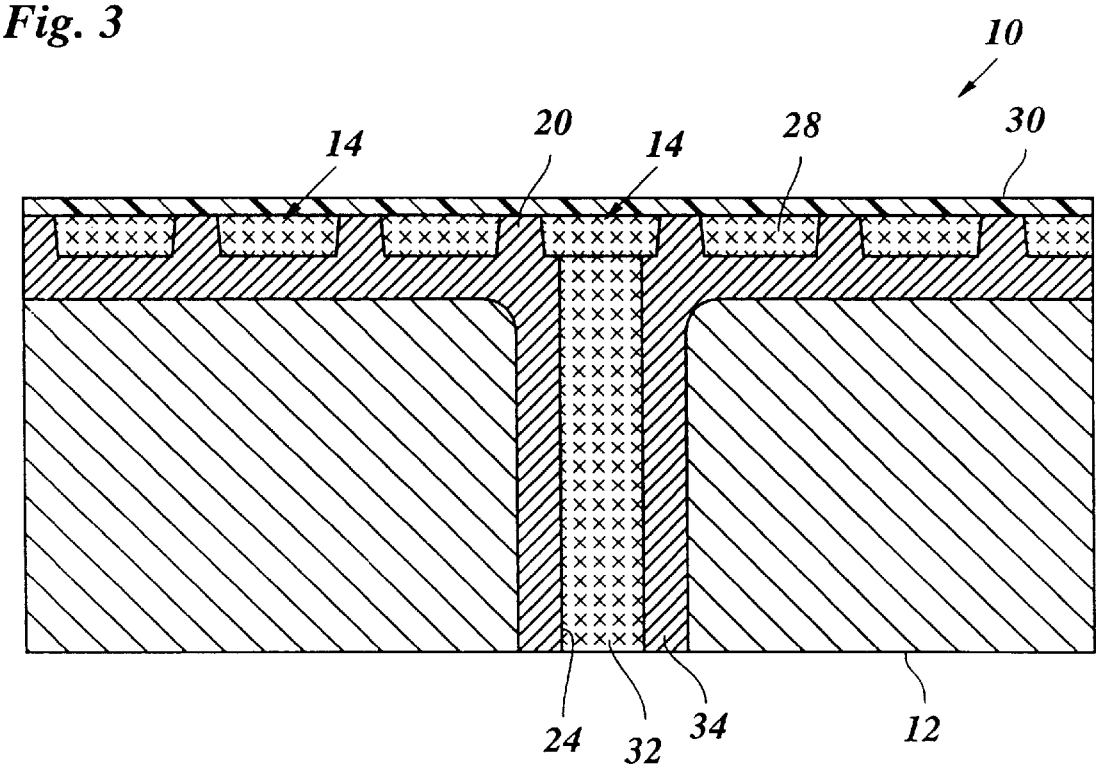
FIG. 3 is a cross-sectional view of a surface portion of the image-forming element.
Figure 4:
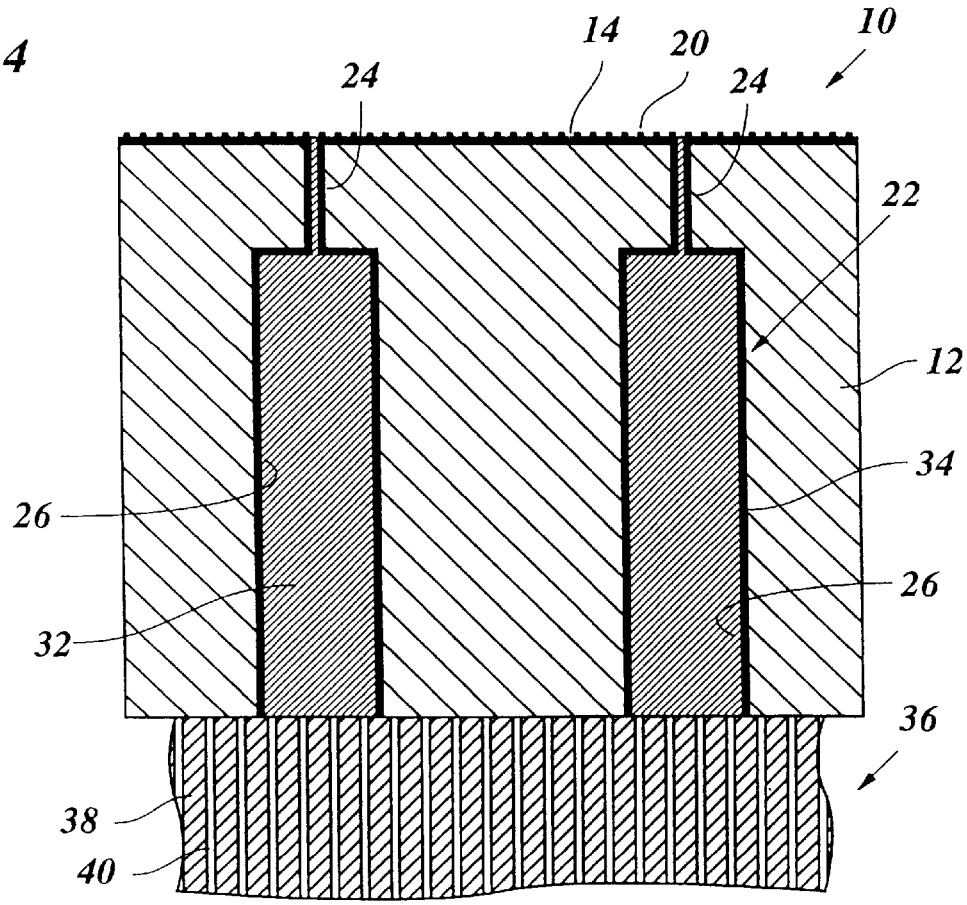
FIG. 4 is a cross-sectional view of a portion of the circumferential wall of the image-forming element shown in a smaller scale relative to FIG. 3.

As is shown in FIGS. 3 and 4, the electrodes 14 are formed as grooves separated by the ridges 20 and filled with electrically conductive material 28. FIG. 3 also shows the dielectric layer 30 covering the electrodes 14 and the ridges 20 as well as the electrically conductive material 32 with which the small diameter portions 24 and the large diameter portions 26 of the through-holes 22 are filled. The conductive materials 28, 32 forming the electrodes 14 and filling the through-holes is electrically insulated from the aluminum drum body 12 by an anodized surface layer 34 (Al2O3) which is present at the outer circumferential surface of the drum body and at the internal walls of the through-holes.

As is shown in FIG. 4, a so-called zebra-strip 36 is disposed at the inner wall surface of the drum body 12 in order to provide an electrical connection between the conductive material 32 filled in the large diameter holes 26 and the conductors of the control unit 16. This zebra-strip 36 is made of a resilient material which is elastically pressed between the internal wall of the drum body 12 and the terminal array 18 of the control unit 16 and is composed of alternating layers 38 which are made electrically conductive and insulating layers 40. Thus, if the terminals of the control unit are arranged to overlap with the holes 26, each conductor is safely connected with the corresponding one of the holes 26 and accordingly with the electrode 14 associated therewith. In the shown embodiment, each hole 26 overlaps with three conductive layers 38 of the zebra-strip, so that an electrical connection is assured via three parallel electrical paths. It will be clear that a zebra strip with a higher pitch results in more than three parallel electrical paths and thus ensures an even higher reliability. In order to keep the adjacent electrodes 14 electrically separated from each other, it is of course necessary to provide separate zebra-strips 36 for each of the rows of through-holes 22 shown in FIG. 2, or to provide multiple row zebra strips.

The zebra-strips 36 may be replaced by a material which has an anisotropic electric conductivity such as an electrically anisotropic lacquer.

A reliable and efficient method for manufacturing an image-forming element as described above will now be explained in conjunction with FIGS. 3 and 4.

At first, the hollow cylindrical drum body 12 is formed as a one-piece member. The grooves 14 which are to form the electrodes are then cut into the circumferential surface of the drum body 12 for example by means of a diamond chisel. Alternatively, these grooves may be formed by means of a laser beam or an electron beam. It should be noted, that, at this stage, the drum body 12 has not yet been anodized so that the grooves 14 are formed in a metal surface which can be machined more easily and more precisely than a metal oxide layer.

In the next step, the large diameter holes 26 are cut into the wall of the drum body 12 from inside, for example by means of a laser beam. The holes 26 are at first formed as blind bores, and the smaller emitter holes 24 are then formed in a second step. The small diameter holes 24 may also be formed with a laser beam, either from the inside or outside of the drum. If they are cut from outside of the drum, the positional relationship between the small diameter holes 24 and the grooves 14 can readily be confirmed. In this case, it will also be possible to form the small diameter holes 24 by punching or cutting with a diamond chisel or the like, instead of using a laser beam or an electron beam.

On the other hand, if the small diameter holes 24 are formed from inside of the drum, it is possible to form the large diameter holes 26 and the small diameter holes 24 in a single step, e.g. by means of a convergent laser beam.

After the through-holes 22 including the small diameter portions 24 and the large diameter portions 26 have been formed, the whole drum body 12 is anodized according to known anodizing techniques, so as to form the insulating metal oxide layer 34 on the whole surface of the drum body, especially on the outer circumferential surface forming the grooves 14 and the ridges 20 and on the internal walls of the through-holes 22.

In the next step, the electrically conductive material 28, 32 is filled into the grooves 14 and into the through-holes 22 so as to complete the electrodes and the electrical through-contacts.

Finally, the insulating dielectric layer 30, which for example may be formed of AlN, $Al_2O_3$ or of SiOx as described in EP-A-0 635 768, is formed over the electrodes 14 and the ridges 20, and the control unit 16 is mounted inside of the drum body to be connected to the through-contacts via the zebra-strips 36.

Depending on the diameter of the drum body 12 and the dimensions of the tools used for forming the large diameter holes 26, it may be necessary that the drum body 12 is composed of two or more segments in order to provide free access to the internal surface. In this case, the large diameter holes 26 are formed by means of a laser beam or electron beam in the individual segments, and then the segments are joined and welded together, preferably by electron beam welding, in order to form the hollow cylindrical drum body 12. In the example shown in FIG. 1, the drum body is composed of two segments 12*a* joined together along weld seams 12*b*.

The outer surface of the drum body 12 is turned in order to obtain an exact cylindrical shape, and then the grooves 14 are cut. These steps are preferably performed on a lathe.

The subsequent steps of the manufacturing process may be the same as have been described above.

Alternatively, the drum body may be anodized immediately after the grooves 14 have been cut, i.e. before the small diameter holes 24 have been formed. In this case, the anodizing process must be so controlled that the insulating oxide layer penetrates into the aluminum body at least to the level of the outer ends of the large diameter holes 26. The small diameter holes 24 are then formed in the oxide layer by laser cutting, punching or the like. Thus, when the conductive material 32 is filled in, it is assured that this material is perfectly insulated from the aluminum body 12.

Figure 6:
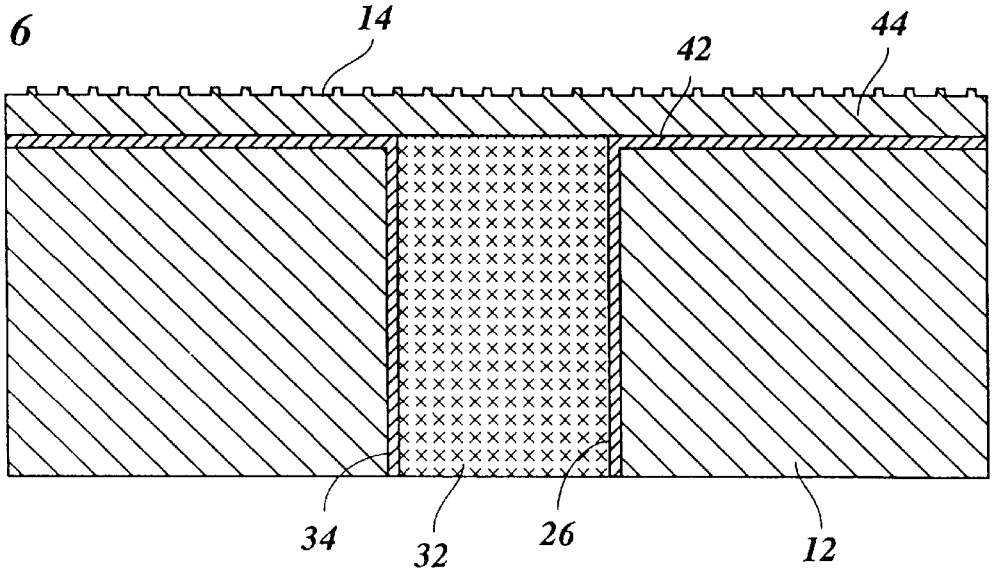
Figure 7:
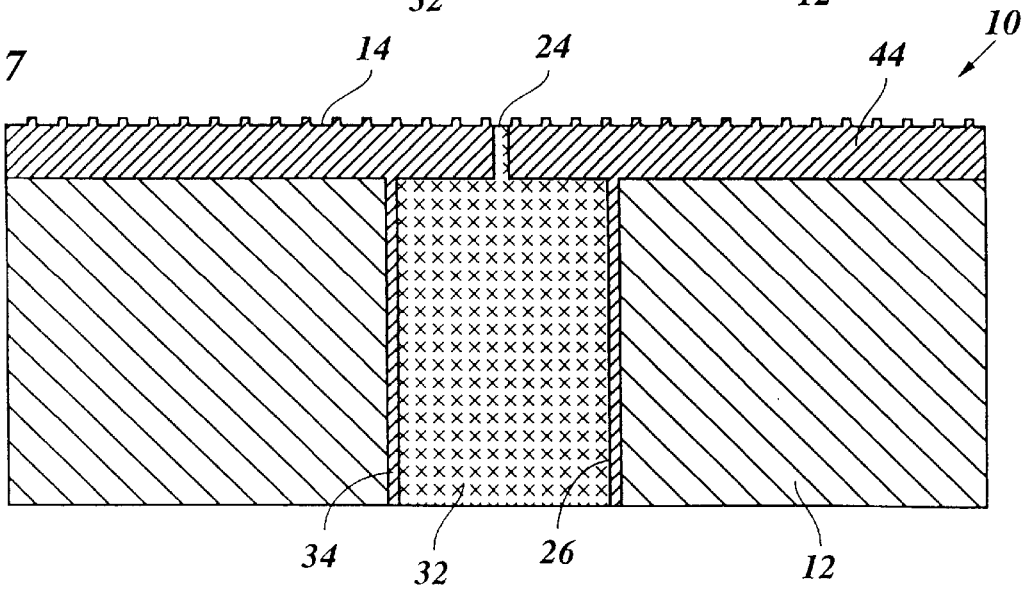

A modified embodiment of an image-forming element and a process for manufacturing the same will now be described in conjunction with FIGS. 5 to 7.

Figure 5:
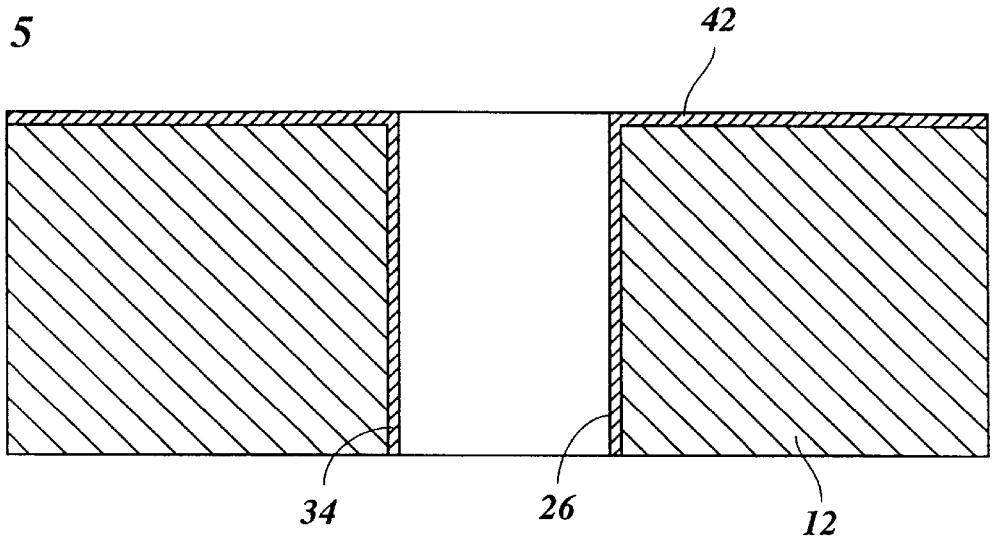
FIGS. 5 to 7 are cross-sectional views similar to FIG. 4 and illustrate three steps in a manufacturing process for an image-forming element according to a modified embodiment.

The main difference to the manufacturing processes described above is that the large diameter hole 26 is at first formed through the entire wall thickness of the drum body 12, as is shown in FIG. 5. The drum body 12 is then anodized to form an insulating layer 42 on the outer circumferential surface of the drum body as well as the insulating surface layer 34 on the internal walls of the holes 26. The holes 26 are filled with the electrically conductive material 32, as is shown in FIG. 6. Then, a layer 44 of metallic aluminum is disposed on the layer 42 on the outer surface of the drum body, for example by vapor deposition. Thereafter, the grooves 14 are cut into the layer 44, as is also shown in FIG. 6.

The drum body 12 is then subjected to a second anodizing step in which the whole thickness of the layer 44 is transformed into an electrically insulating metal oxide. Finally, the small diameter holes 24 are formed through the insulating layer 44 and are filled with electrically conductive material to achieve the configuration shown in FIG. 7.

In this embodiment, the same techniques as in the previous embodiment may be used for forming the large diameter holes 26 and the small diameter holes 24. Thus, the drum body 12 may either be an integral hollow cylindrical body from the outset or may be composed of several segments welded together after the holes 26 have been formed.

Figure 8:
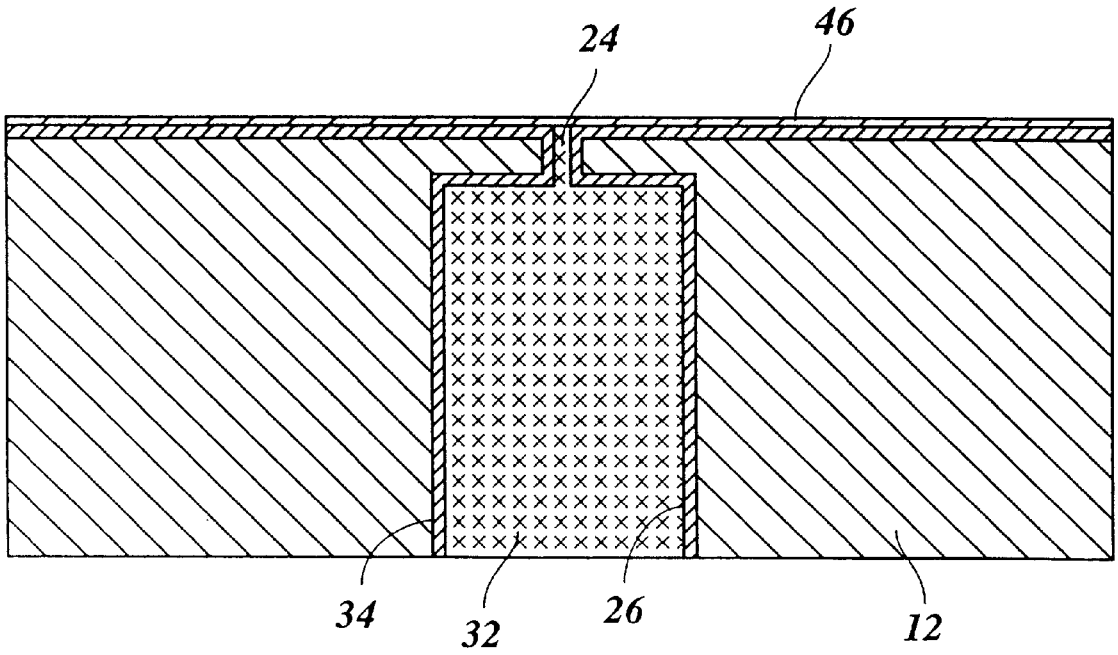
FIG. 8 is a cross-sectional view illustrating another manufacturing process.
Figure 9:
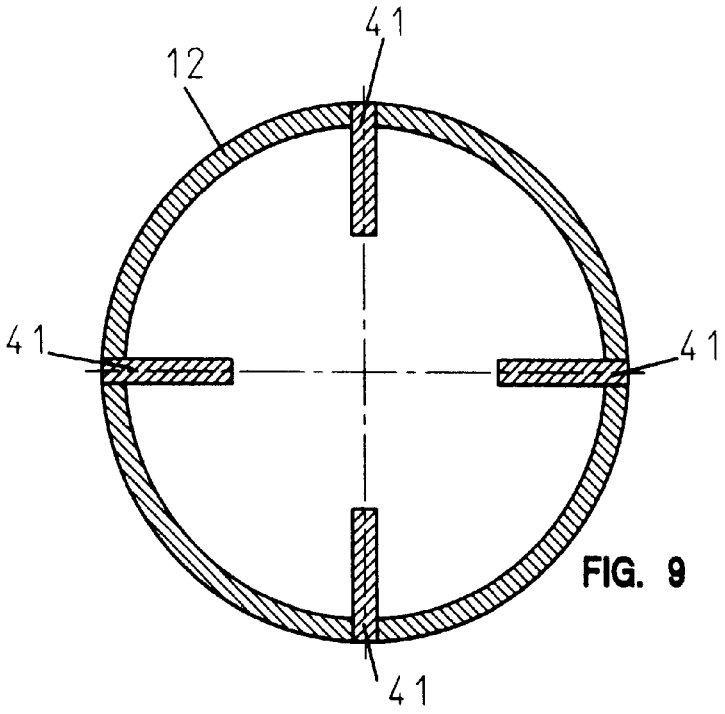
FIGS. 9 to 12 are schematic, cross-sectional views illustrating the manufacturing steps of another embodiment for manufacturing an image-forming element according to the invention.
Figure 10:
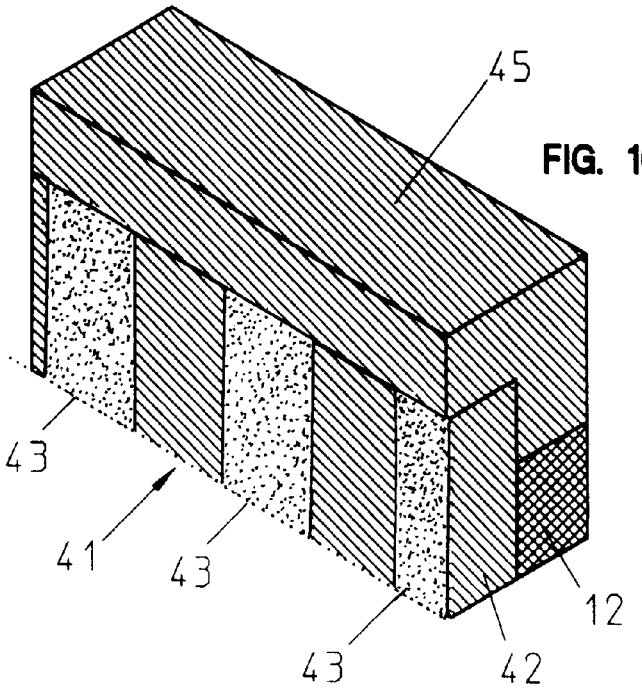
Figure 11:
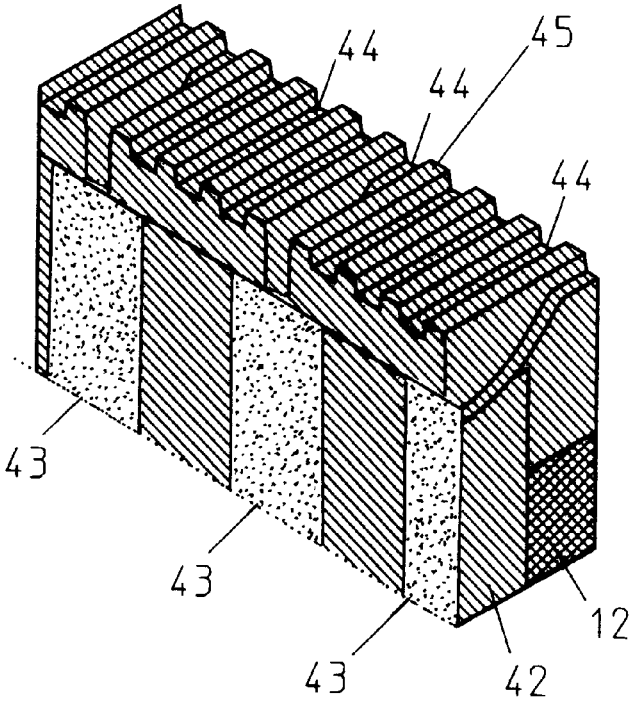
Figure 12:
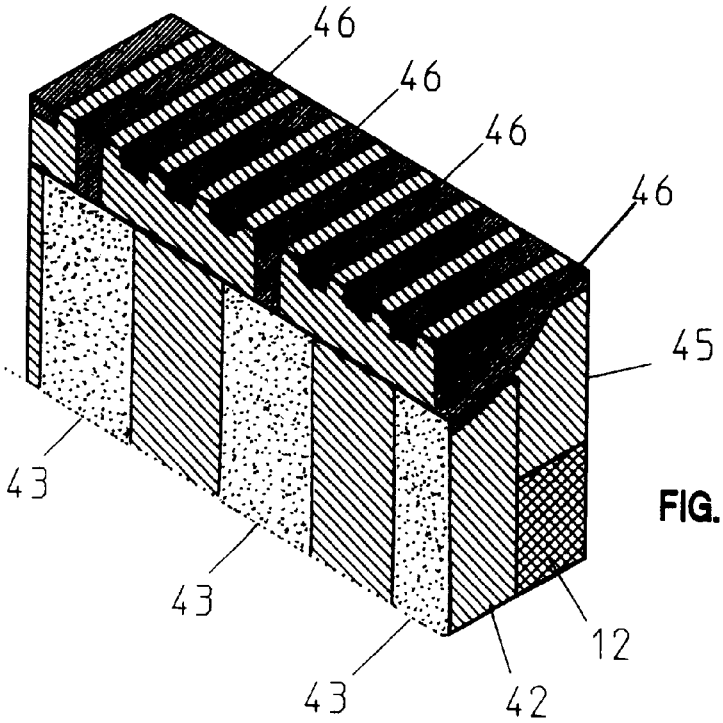

According to a modification of the manufacturing process, the large diameter holes 26 and the small diameter holes 24 may be formed in the same way as has been described in conjunction with FIGS. 3 and 4, but without forming the grooves 14 in the outer surface of the drum body. If the drum body is composed of several segments, these segments may be welded together either before or after the small diameter holes 24 have been formed. The drum body is then subjected to a first anodizing step, and the large diameter holes 26 and the small diameter holes 24 are filled with conductive material 32. Then, as is shown in FIG. 8, a continuous layer 46 of metallic aluminum is applied on the outer surface of the drum body 12, thus covering the open ends of the small diameter holes 24.

Subsequently, the grooves 14 are cut into the layer 46, so that the outward ends of the small diameter holes 24 are again exposed at the bottoms of the grooves. The remaining parts of the layer 46 (i.e. the ridges 20) are then made electrically insulating in a second anodizing step, so that a configuration similar to that of FIG. 7 is achieved.

Finally, the grooves 14 are filled with conductive material 28, and the dielectric layer 30 is applied as has been described in conjunction with FIG. 3.

FIGS. 9–12 show another embodiment of an image-forming element of the present invention. The hollow cylindrical body 12 is provided with a number (e.g. four) elongated openings and in each such elongated opening a support element 41 is secured. Each support element 41, as shown e.g. in FIG. 10 comprises an insulating support 42 (or a conductive support provided with an insulating surface layer), on which a row of contact means 43 is carried. The contact means 43, in this embodiment, have a rectangular cross-section, but obviously may also have a circular or otherwise shaped cross-section. The length of the contact means, when considered in an axial direction of the cylindrical body 12 is about three to four times the corresponding length of the electrodes 46 (FIG. 12) to be formed on the circumferential surface of the body 12. Typically the electrodes 46 are 40 $\mu$m wide in an axial direction of body 12 and the contact means 43 measure 150 $\mu$m. The support elements 41 are secured in the elongated opening of the body 12 with an insulating adhesive such as an electrograde epoxy resin, and in such a way that the element 41 projects about 50 to 100 $\mu$m above the surface of the body 12. Alternately, the elements 41 can be secured in the elongated opening such that the end of the element is positioned at the surface of the drum body 12 but does not substantially protrude from the surface. Subsequently the drum body 12 can be etched away to such a depth that the elements 41 protrude about 50 to 100 $\mu$m above the surface. The elements 41 are further so adjusted that the contact means 43, considered in the peripheral direction of body 12 are staggered in the same manner as described hereinbefore with reference to FIG. 2. The peripheral surface of body 12 is subsequently coated with an insulating surface layer 45 having a thickness such that the thickness of the layer section covering the support element 41, after the layer 45 is finished to achieve a cylindrical periphery, amounts to about 100 $\mu$m. The image forming electrodes 46 are formed by forming (e.g. on a lathe or using a laser beam) in the outer surface of the insulating layer 45 a number of endless grooves 44 peripherally extending parallel to one another. The grooves have a depth of about 40 $\mu$m, but in the region where the electrode 46, must be connected with contact means 43, the groove 44 is deepened until the conductive material forming the contact means 43 is exposed. The grooves 44 are then filled with electrically conductive material as described herein before with reference to FIGS. 3 and 4. Finally, the peripheral surface of the layer 45 and electrodes 46 is provided with a thin dielectric layer (not shown in the figures) having a thickness of approximately 1 $\mu$m and consisting of silicon oxide as described in EPT 0 635 768. The contact means 43 are connected with a control unit (not shown in the FIGS. 9–12) for selectively energizing the electrodes 46 in the same manner as described before with reference to FIG. 4.

While only specific embodiments of the invention have been described above, it will occur to a person skilled in the art that the described examples may be modified in various ways without departing from the scope of the invention as defined in the appended claims. For example, the control unit 16 may be divided into several blocks angularly offset from one another and extending each over a different part of the length of the drum body. The through-holes 22 will then be arranged in accordance with this pattern.

We claim:

1. An image-forming element comprising:

a hollow cylindrical drum body including an outer circumferential surface having a plurality of circumferentially extending electrodes electrically insulated from one another and from the drum body;

an electronic control unit disposed inside of the hollow cylindrical drum body for energizing said electrodes; and a plurality of contact means for electrically connecting each of the electrodes individually to the control unit, said contact means passing through a wall of said hollow cylindrical drum body and being arranged in a plurality of rows extending in an axial direction of the hollow cylindrical drum, said contact means as viewed from an inner side of the wall of said hollow cylindrical drum body, includes a dimension, considered in the axial direction of the hollow cylindrical drum body, which is at least twice the corresponding dimension of an electrode.

2. The image-forming element according to claim 1, wherein each of said contact means comprises a through hole having a small diameter outer portion adjoining an associated one of the electrodes and a large diameter portion which has a diameter at least twice the width of an electrode and is open to the inner surface of the hollow cylindrical drum body, the through holes having an insulating inner wall and being filled with electrically conductive material.

3. The image forming element according to claim 2, wherein the cylindrical body is metallic and the insulating inner wall of the through holes is formed by an anodized surface layer of the metal of said hollow cylindrical drum body.

4. The image forming element according to claim 1, wherein at least one continuous strip having anisotropic electrical conductivity is interposed between inner ends of the contact means and a linear array of contact terminals of the control unit.

5. The image forming element according to claim 2, wherein at least one continuous strip having anisotropic electrical conductivity is interposed between inner ends of the contact means and a linear array of contact terminals of the control unit.

6. The image forming element according to claim 1, wherein said rows of contact means are provided on one or more supports which are mounted in a circumferential well of the hollow cylindrical drum body.

* * * * *